US010174942B2

(12) United States Patent
Kashiwagi et al.

(10) Patent No.: US 10,174,942 B2
(45) Date of Patent: Jan. 8, 2019

(54) COMBUSTION-TYPE EXHAUST GAS TREATMENT APPARATUS

(75) Inventors: Seiji Kashiwagi, Tokyo (JP); Kotaro Kawamura, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 1050 days.

(21) Appl. No.: 13/388,483

(22) PCT Filed: Jul. 30, 2010

(86) PCT No.: PCT/JP2010/062868

§ 371 (c)(1),
(2), (4) Date: Feb. 2, 2012

(87) PCT Pub. No.: WO2011/016393

PCT Pub. Date: Feb. 10, 2011

(65) Prior Publication Data

US 2012/0128541 A1 May 24, 2012

(30) Foreign Application Priority Data

Aug. 7, 2009 (JP) ..... 2009-184636

(51) Int. Cl.

*F23G 7/06* (2006.01)
*F23G 5/32* (2006.01)
*F23J 1/06* (2006.01)

(52) U.S. Cl.

CPC ..... *F23G 7/065* (2013.01); *F23G 5/32* (2013.01); *F23J 1/06* (2013.01); *F23G 2202/101* (2013.01)

(58) Field of Classification Search

USPC .... 431/5, 4, 3, 8, 9, 10, 12, 29, 32, 75, 353, 431/354; 422/210; 239/413, 422, 424,
(Continued)

(56) References Cited

U.S. PATENT DOCUMENTS 1,367,947 A * 2/1921 Chadick ..... 431/32
1,463,216 A * 7/1923 Krase et al. ..... 422/205
(Continued)

FOREIGN PATENT DOCUMENTS

CN 101357295 A 2/2009
CN 101398182 A 4/2009
(Continued)

OTHER PUBLICATIONS

International Search Report dated Oct. 19, 2010 in International (PCT) Application No. PCT/JP2010/062868.
(Continued)

*Primary Examiner* — Steven B McAllister
*Assistant Examiner* — Desmond C Peyton
(74) *Attorney, Agent, or Firm* — Wenderoth, Lind & Ponack, L.L.P.

(57) ABSTRACT

A combustion-type exhaust gas treatment apparatus has a combustion treatment chamber for treating exhaust gas by combusting and decomposing the exhaust gas, a main burner for forming a flame in the combustion treatment chamber by supplying a mixture gas produced by premixing a fuel gas and an oxidizing gas, and a scraper for scraping off solid matters adhering to an inner wall of the combustion treatment chamber. The mixture gas is adjusted within combustion range and supplied to the main burner during treatment for treating the exhaust gas by combusting and decomposing the exhaust gas when the scraper is not in operation, and the mixture gas is adjusted outside combustion range and supplied to the main burner during treatment for treating the exhaust gas by combusting and decomposing the exhaust gas when the scraper is in scraping operation.

8 Claims, 7 Drawing Sheets

(58) Field of Classification Search
USPC ..... 239/428; 205/628
See application file for complete search history.

(56) References Cited

U.S. PATENT DOCUMENTS

| | | | | |
|---|---|---|---|---|
| 5,123,836 | A * | 6/1992 | Yoneda et al. | 431/5 |
| 5,183,646 | A | 2/1993 | Anderson et al. | |
| 5,566,625 | A * | 10/1996 | Young | F23C 99/005 110/243 |
| 5,694,909 | A * | 12/1997 | Kato | F02B 61/045 123/672 |
| 6,253,689 | B1 * | 7/2001 | Futatsugi | F23G 5/04 110/203 |
| 6,948,929 | B2 * | 9/2005 | Komai et al. | 431/354 |
| 6,969,250 | B1 * | 11/2005 | Kawamura et al. | 431/185 |
| 2003/0054299 | A1 * | 3/2003 | Kawamura et al. | 431/5 |
| 2004/0028590 | A1 * | 2/2004 | Tsuji et al. | 423/245.3 |
| 2005/0226790 | A1 * | 10/2005 | Park et al. | 422/173 |
| 2012/0199083 | A1 * | 8/2012 | Besmann | 123/3 |
| 2013/0239857 | A1 * | 9/2013 | Kim et al. | 110/213 |

FOREIGN PATENT DOCUMENTS

| | | |
|---|---|---|
| JP | 11-193916 | 7/1999 |
| JP | 2003-343826 | 12/2003 |
| JP | 2004-28546 | 1/2004 |
| JP | 2006-275307 | 10/2006 |
| JP | 2007-263554 | 10/2007 |
| TW | 438950 B | 6/2001 |
| TW | 542886 B | 7/2003 |
| TW | I228582 B | 3/2005 |
| WO | 94/23246 | 10/1994 |

OTHER PUBLICATIONS

Extended European Search Report dated Nov. 8, 2016 in European Application No. 10806392.6.

* cited by examiner

COMBUSTION-TYPE EXHAUST GAS TREATMENT APPARATUS

TECHNICAL FIELD

The present invention relates to a combustion-type exhaust gas treatment apparatus for treating an exhaust gas containing a silane-based gas ($SiH_4$, TEOS or the like), a halogen-based gas ($NF_3$, $ClF_3$, $SF_6$, $CHF_3$ or the like), a PFC gas ($CF_4$, $C_2F_6$ or the like) or the like by combusting and decomposing the exhaust gas to make the exhaust gas harmless.

BACKGROUND ART

Exhaust gases containing a silane-based gas or a PFC gas are discharged from a manufacturing process for manufacturing semiconductor devices, liquid crystal panels, solar cells or the like. Such exhaust gases have negative effects on the human body and on the global environment such as a cause of global warming or the like if remain untouched. Therefore, it is not preferable that these exhaust gases are emitted to the atmosphere as they are. Accordingly, these exhaust gases are generally introduced into a combustion-type exhaust gas treatment apparatus where the exhaust gases are made harmless by oxidation through combustion. As a method for treating the exhaust gases, a method in which flames are formed using a fuel gas in a furnace and the exhaust gases are combusted by the flames is widely used.

In such combustion-type exhaust gas treatment apparatus, when the exhaust gases containing silane ($SiH_4$) are treated through combustion (oxidatively treated), silica ($SiO_2$) is produced as expressed by the following reaction formula.

$$SiH_4+2O_2 \rightarrow SiO_2+2H_2O$$

The produced silica ($SiO_2$) is powdery, and adheres to an inner wall of a combustion treatment chamber and becomes increasingly deposited. Therefore, it is necessary to remove periodically solidified powdery material containing silica which has adhered to and has been deposited in the combustion treatment chamber. Thus, a scraper is installed to scrape off the solid matters from the wall surface of the combustion treatment chamber in the exhaust gas treatment apparatus.

The exhaust gas treatment apparatus having this kind of scraper is disclosed in, for example, Japanese Laid-Open Patent Publication No. 2006-275307 and Japanese Laid-Open Patent Publication No. 11-193916.

CITATION LIST

Patent Literature

PTL 1: Japanese Laid-Open Patent Publication No. 2006-275307

PTL 2: Japanese Laid-Open Patent Publication No. 11-193916

The above exhaust gas treatment apparatus is connected to a downstream side of a manufacturing apparatus for manufacturing semiconductor devices, liquid crystal panels, solar cells or the like. Therefore, when the exhaust gas treatment apparatus is stopped due to maintenance or failure, the manufacturing apparatus such as CVD connected to the exhaust gas treatment apparatus must be stopped. Once the manufacturing apparatus has been stopped, it takes time to resume operation of the manufacturing apparatus, thus lowering throughput of the manufacturing line. Therefore, it is desirable that the exhaust gas treatment apparatus can be operated continuously over a prolonged period of time.

However, in the above conventional exhaust gas treatment apparatus, in the case where the solid matters such as silica have adhered to and have been deposited in the combustion treatment chamber, normally, supply of a fuel gas and an exhaust gas is stopped to stop combustion treatment of the exhaust gas temporarily. In this state, the scraper is operated to scrape off the solid matters from the wall surface of the combustion treatment chamber. This is because it has been considered that if the scraper is operated during combustion treatment of the exhaust gas, the scraper travels in a combustion atmosphere of the fuel gas and in a combustion atmosphere of the exhaust gas to cause adverse effects on combustion of the fuel gas and combustion of the exhaust gas, and thus it is difficult to maintain combustion in a safe and stable state. In particular, it has been considered that in the exhaust gas treatment apparatus having a main burner, provided on an inner circumferential wall of a combustion treatment chamber, for ejecting a fuel gas or a mixture gas of a fuel gas and oxygen to form combustion flames toward the combustion treatment chamber, the scraper passes transversely across the main burner section in the midst of operation of the main burner to cause significant effects on combustion flames of the main burner.

The present inventors have conducted repeatedly the following processes: A type of exhaust gas treatment apparatus having a premixer for premixing a fuel gas and oxygen at an upstream side of the main burner has been continuously operated, and the scraper has been operated during combustion treatment of the exhaust gas to scrape off the solid matters such as silica ($SiO_2$) deposited on the inner circumferential wall of the combustion treatment chamber. As a result, the present inventors have found that when the scraper is operated during combustion treatment of the exhaust gas, a backfire occurs into a main burner pipe (pipe connecting the main burner and the premixer) in some cases. The reason for this is as follows: It is considered that because the mixture gas of fuel gas and oxygen is supplied from the main burner, blowing flow velocity of the mixture gas from nozzles of the main burner becomes nonuniform due to hydrodynamic pressure fluctuation or the like in the vicinity of the nozzles of the main burner caused by operation of the scraper, thus causing the backfire into the main burner pipe.

SUMMARY OF THE INVENTION

The present invention has been made in view of the above circumstances. It is therefore a first object of the present invention to provide a combustion-type exhaust gas treatment apparatus which can be operated continuously over a prolonged period of time by operating a scraper for scraping off solid matters adhering to an inner wall of a combustion treatment chamber to remove the solid matters from the inner wall of the combustion treatment chamber during combustion treatment of an exhaust gas.

Further, it is a second object of the present invention to provide the combustion-type exhaust gas treatment apparatus which can prevent a backfire into a main burner pipe from occurring even if the scraper for scraping off solid matters adhering to the inner wall of the combustion treatment chamber is operated during combustion treatment of the exhaust gas and passes transversely across a main burner section.

In order to achieve the above objects, according to a first aspect of the present invention, there is provided a combustion-type exhaust gas treatment apparatus having a combustion treatment chamber configured to treat an exhaust gas by combusting and decomposing the exhaust gas, a main burner configured to form a flame in the combustion treatment chamber by supplying a mixture gas produced by premixing a fuel gas and an oxidizing gas, and a scraper configured to scrape off solid matters adhering to an inner wall of the combustion treatment chamber, characterized in that: the mixture gas is adjusted within combustion range and supplied to the main burner during treatment for treating the exhaust gas by combusting and decomposing the exhaust gas and at the time when the scraper is not in operation; and the mixture gas is adjusted outside combustion range and supplied to the main burner during treatment for treating the exhaust gas by combusting and decomposing the exhaust gas and at the time when the scraper is in scraping operation.

According to the first aspect of the present invention, a mixture gas produced by premixing a fuel gas and an oxidizing gas is adjusted within combustion range and supplied to the main burner during treatment for treating the exhaust gas by combusting and decomposing the exhaust gas and at the time when the scraper is not in operation. Because the mixture gas supplied to the main burner is within the combustion range, the mixture gas is combusted when the mixture gas is blown off from the main burner, thus forming flames. Thus, the exhaust gas introduced into the combustion treatment chamber is combusted and treated by the flames of the main burner. In this case, as an oxidizing gas, for example, oxygen is used. The mixture gas produced by premixing a fuel gas and an oxidizing gas is adjusted outside combustion range and supplied to the main burner during treatment for treating the exhaust gas by combusting and decomposing the exhaust gas and at the time when the scraper is in scraping operation. Because the mixture gas supplied to the main burner is poor in oxygen and is outside the combustion range, the mixture gas is not combusted when it is blown off from the main burner. In this manner, by making the mixture gas in the main burner and the main burner pipe outside the combustion range, a backfire into the main burner and the main burner pipe can be prevented. Then, the mixture gas which is blown off from the main burner and is outside the combustion range is mixed with oxygen, air or the like which is separately supplied, and becomes within the combustion range and is combusted to form flames. By these flames, the exhaust gas introduced into the combustion treatment chamber is combusted and treated. In this case, as an oxidizing gas, for example, air is used.

Here, as a fuel gas, utility gas, natural gas, propane gas or the like is used. The oxidizing gas is defined as a gas which assists combustion of the combustibles, and in the present invention, the oxidizing gas is defined as a gas containing an oxygen source such as oxygen, air or the like.

The mixture gas of the fuel gas and the oxidizing gas cannot be combusted if the concentration of the fuel gas is too low or too high. The limit of concentration of the fuel gas contained in the mixture gas which can be combusted is referred to as combustion limit. The combustion limit of low concentration of the fuel gas is referred to as lower limit, and the combustion limit of high concentration of the fuel gas is referred to as upper limit. When the concentration of the fuel gas is within the range between the lower limit and the upper limit, the fuel gas is combusted, and hence this concentration range is referred to as combustion range. The range which is not included in the combustion range is referred to as outside combustion range.

In a preferred aspect of the present invention, the mixture gas is adjusted within the combustion range or outside the combustion range by changing component ratio of oxygen in the oxidizing gas.

According to the present invention, the component ratio of oxygen in the oxidizing gas is set to 100% or around 100%, that is, oxygen is used as an oxidizing gas and a flow-rate mixture ratio of the oxidizing gas and a certain amount of fuel gas is set within the combustion range. Here, by setting the component ratio of oxygen in the oxidizing gas to 21%, i.e., by using air as the oxidizing gas, the mixture gas can be adjusted outside the combustion range without changing the flow-rate mixture ratio of the fuel gas and the oxidizing gas.

In a preferred aspect of the present invention, the oxidizing gas comprises oxygen or air.

By using oxygen as the oxidizing gas, the mixture gas can be adjusted within the combustion range. Further, by using air as the oxidizing gas, the mixture gas can be adjusted outside the combustion range.

According to a second aspect of the present invention, there is provided a combustion-type exhaust gas treatment apparatus having a combustion treatment chamber configured to treat an exhaust gas by supplying a fuel, oxygen and air and by combusting and decomposing the exhaust gas, and a scraper configured to scrape off solid matters adhering to an inner wall of the combustion treatment chamber, characterized in that: the locations for supplying oxygen and/or air to the combustion treatment chamber are switched at the time when the scraper is not in operation and at the time when the scraper is in scraping operation during treatment for treating the exhaust gas by combusting and decomposing the exhaust gas.

According to the second aspect of the present invention, for example, a fuel and oxygen are supplied to the main burner to form a flame and air is supplied to a nozzle for supplying a swirling flow in the combustion treatment chamber during treatment for treating the exhaust gas by combusting and decomposing the exhaust gas and at the time when the scraper is not in operation. The exhaust gas is combusted by being mixed with the flame of the main burner. For example, fuel and air are supplied to the main burner, and oxygen in addition to air is supplied to the nozzle for forming the swirling flow in the combustion treatment chamber during treatment for treating the exhaust gas by combusting and decomposing the exhaust gas and at the time when the scraper is in scraping operation. The fuel blown off from the main burner is mixed with the air supplied to the main burner and the oxygen supplied to the swirling flow nozzle and is thus combusted to form a flame. The exhaust gas is mixed with this flame and is combusted.

In a preferred aspect of the present invention, the combustion treatment chamber comprises a main burner configured to form a flame in the combustion treatment chamber by supplying a fuel, and a nozzle configured to form a swirling flow by ejecting a gas into the combustion treatment chamber; the fuel and the oxygen are supplied to the main burner to form the flame in the combustion treatment chamber and the air is supplied to the nozzle to form a swirling flow in the combustion treatment chamber when the scraper is not in operation; and the fuel and the air are supplied to the main burner and the air and the oxygen are supplied to the nozzle to combust the fuel in the combustion treatment chamber, thereby forming the flame when the scraper is in scraping operation.

According to a third aspect of the present invention, there is provided a combustion-type exhaust gas treatment apparatus having a combustion treatment chamber configured to combust and decompose an exhaust gas by supplying a fuel, oxygen and air, and a scraper configured to scrape off solid matters adhering to an inner wall of the combustion treatment chamber, characterized in that: the combustion treatment chamber comprises a pilot burner configured to ignite at the start of treating the exhaust gas, and a main burner for maintaining a flame during treatment for treating the exhaust gas by combusting and decomposing the exhaust gas; the fuel is supplied from the main burner to the combustion treatment chamber and combustion in the pilot burner is stopped during treatment for treating the exhaust gas by combusting and decomposing the exhaust gas and at the time when the scraper is not in operation; and the fuel is supplied from the main burner to the combustion treatment chamber and combustion in the pilot burner is maintained during treatment for treating the exhaust gas by combusting and decomposing the exhaust gas and at the time when the scraper is in scraping operation.

According to the third aspect of the present invention, because the pilot burner used for start-up when treatment of the exhaust gas is started is being ignited during treatment for treating the exhaust gas by combusting and decomposing the exhaust gas and at the time when the scraper is in scraping operation, a flame is prevented from being extinguished during operation of the scraper.

In a preferred aspect of the present invention, an ejector mechanism is provided in a pathway for supplying the fuel to the pilot burner.

According to the present invention, by providing an ejector mechanism in a fuel supply pathway of the pilot burner for start-up to raise a pressure of the fuel blown off from the pilot burner, the pilot burner flame is insusceptible to pressure fluctuation, and thus the flame of the pilot burner can be stabilized. Therefore, during operation of the scraper, the flame can be prevented from being extinguished in the combustion treatment chamber.

In a preferred aspect of the present invention, the fuel and the oxygen are supplied from the main burner to the combustion treatment chamber during treatment for treating the exhaust gas by combusting and decomposing the exhaust gas and at the time when the scraper is not in operation; and the fuel and the air are supplied from the main burner to the combustion treatment chamber during treatment for treating the exhaust gas by combusting and decomposing the exhaust gas and at the time when the scraper is in scraping operation.

According to the present invention, the fuel and the oxygen are supplied from the main burner to the combustion treatment chamber to form a flame during treatment for treating the exhaust gas by combusting and decomposing the exhaust gas and at the time when the scraper is not in operation. The exhaust gas is combusted by the flame of the main burner. The fuel and the air are supplied from the main burner to the combustion treatment chamber during treatment for treating the exhaust gas by combusting and decomposing the exhaust gas and at the time when the scraper is in scraping operation. The fuel blown off from the main burner is mixed with the air blown off from the main burner and the oxidizing gas separately supplied and is combusted to form a flame. The exhaust gas is combusted by this flame.

In a preferred aspect of the present invention, the oxygen is supplied to the combustion treatment chamber from a location different from a location of the main burner during treatment for treating the exhaust gas by combusting and decomposing the exhaust gas and at the time when the scraper is in scraping operation.

According to the present invention, by supplying the oxygen to the combustion treatment chamber from a location different from a location of the main burner during treatment for treating the exhaust gas by combusting and decomposing the exhaust gas and at the time when the scraper is in scraping operation, the fuel blown off from the main burner is mixed with the oxygen supplied from the location different from the location of the main burner and is combusted to form a flame. The exhaust gas is combusted by this flame.

In the present invention, the fuel and the oxygen can be supplied in the premixed state from the main burner to the combustion treatment chamber. Also, the fuel and the air can be supplied in the premixed state from the main burner to the combustion treatment chamber.

According to a fourth aspect of the present invention, there is provided a combustion-type exhaust gas treatment apparatus having a cylindrical combustion treatment chamber configured to treat an exhaust gas by combusting and decomposing the exhaust gas, an exhaust gas inlet formed so as to face the combustion treatment chamber, a supply port of a fuel and a supply port of an oxidizing gas formed at a side surface of the combustion treatment chamber, and a scraper configured to scrape off solid matters adhering to an inner wall of the combustion treatment chamber, characterized in that: the scraper passes transversely across the supply port of the fuel to scrape off solid matters near the supply port of the fuel by operating the scraper to actuate the scraper vertically during treatment for treating the exhaust gas by combusting and decomposing the exhaust gas; and the scraper retreats at a location away from the supply port of the fuel and the supply port of the oxidizing gas at the time when the scraper is not in operation.

According to the fourth aspect of the present invention, the scraper is operated at a predetermined timing to move vertically during treatment for treating the exhaust gas by combusting and decomposing the exhaust gas, thereby scraping off the solid matters adhering to the inner wall of a portion where the supply port of the fuel is located in the combustion treatment chamber. In this manner, by removing the solid matters even when combustion decomposition of the exhaust gas is carried out, prolonged continuous operation of the exhaust gas treatment apparatus becomes possible.

In a preferred aspect of the present invention, the scraper scrapes off the solid matters adhering to an inner wall of a burner section for forming a flame in the combustion treatment chamber by supplying the fuel gas or the fuel.

The scraper retreats at a standby position near the top plate of the burner section when the scraper is not in operation.

In a preferred aspect of the present invention, the combustion-type exhaust gas treatment apparatus further comprises a second scraper for scraping off the solid matters adhering to the inner wall of a combustion chamber, located below the burner section, for treating the exhaust gas by combusting and decomposing the exhaust gas.

In a preferred aspect of the present invention, the second scraper retreats at a standby position of a cooling section, located below the combustion chamber, for cooling the exhaust gas at the time when the second scraper is not in operation.

Advantageous Effects of Invention

According to the present invention, the following effects can be achieved.

(1) By operating the scraper which scrapes the solid matters adhering to the inner wall of the combustion treatment chamber to remove the solid matters from the inner wall of the combustion treatment chamber during treatment for treating the exhaust gas by combusting and decomposing the exhaust gas, prolonged continuous operation of the apparatus becomes possible.

(2) By adjusting the mixture gas produced by premixing the fuel gas and the oxidizing gas outside the combustion range and supplying the mixture gas to the main burner during treatment for treating the exhaust gas by combusting and decomposing the exhaust gas and at the time when the scraper is in operation to scrape off the solid matters adhering to the inner wall of the combustion treatment chamber, a backfire into the main burner and the main burner pipe can be prevented.

(3) During treatment for treating the exhaust gas by combusting and decomposing the exhaust gas and at the time when the scraper is in operation to scrape off the solid matters adhering to the inner wall of the combustion treatment chamber, by igniting the pilot burner for start-up and supplying a pilot light into the combustion treatment chamber, a flame in the combustion treatment chamber is prevented from being extinguished during operation of the scraper.

(4) By providing an ejector mechanism in a fuel supply pathway of the pilot burner for start-up to raise a pressure of the fuel blown off from the pilot burner, the pilot burner flame is insusceptible to pressure fluctuation, and thus the flame of the pilot burner can be stabilized. Therefore, during operation of the scraper, the flame can be prevented from being extinguished in the combustion treatment chamber.

DETAILED DESCRIPTION OF THE INVENTION

Figure 1:
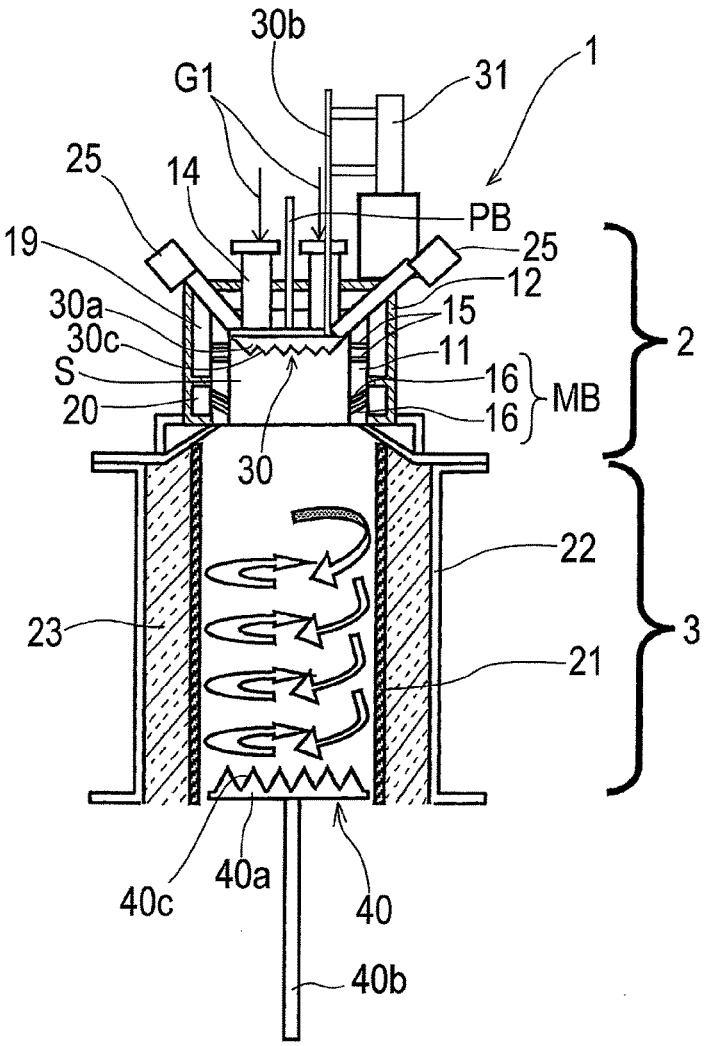
FIG. 1 is a schematic cross-sectional view showing a structural example of a combustion treatment chamber of a combustion-type exhaust gas treatment apparatus according to the present invention.

A combustion-type exhaust gas treatment apparatus according to embodiments of the present invention will be described in detail with reference to FIGS. 1 through 7. The same or corresponding members or elements having the same operation or function are denoted by the same reference numerals throughout views.

FIG. 1 is a schematic cross-sectional view showing a structural example of a combustion treatment chamber of the combustion-type exhaust gas treatment apparatus according to the present invention. A combustion treatment chamber 1 is composed of a cylindrical vessel as a whole and comprises a burner section 2 at an upper part and a combustion chamber 3 at a lower part. In FIG. 1, a cooling section or the like located below the combustion chamber 3 is omitted from the illustration.

The burner section 2 has a cylindrical member 11 having a bottom which forms a space S for forming flames by a burner and combusting the exhaust gas, and an outer cylinder 12 provided so as to surround the cylindrical member 11 with a predetermined space therebetween. Between the cylindrical member 11 and the outer cylinder 12, an air chamber 19 for retaining combustion air and a mixture gas chamber 20 for retaining a mixture gas of a fuel gas (fuel) and an oxidizing gas (for example, oxygen) are formed. The air chamber 19 and the mixture gas chamber 20 communicate with an air supply source and an ejector, respectively (described later). Exhaust gas introduction pipes 14 for introducing an exhaust gas G1 containing silane ($SiH_4$) or the like discharged from, for example, a semiconductor device manufacturing apparatus into the space S are connected to a top plate portion (top portion) of the cylindrical member 11.

A plurality of air nozzles 15 for providing communication between the air chamber 19 and the space S and a main burner MB comprising a plurality of nozzles 16 for providing communication between the mixture gas chamber 20 and the space S are provided in the cylindrical member 11. The air nozzles 15 extend at a predetermined angle to the tangential direction of the cylindrical member 11 to blow off air so as to produce swirling flows in the space S. Similarly, the nozzles 16 of the main burner MB extend at a predetermined angle to the tangential direction of the cylindrical member 11 to blow off a mixture gas so as to form swirling flows in the space S. The air nozzles 15 and the nozzles 16 of the main burner MB are disposed at predetermined intervals in the circumferential direction of the cylindrical member 11.

The combustion chamber 3 is a space for combusting the exhaust gas by retaining flames formed in the burner section 2 at the subsequent stage of the burner section 2, and is defined by an inner cylinder 21 disposed so as to be contiguous with the burner section 2. A cylindrical outer cylinder 22 is provided outside the inner cylinder 21 so as to surround the inner cylinder 21. The inner cylinder 21 is formed by fiber-reinforced ceramics, and the outer cylinder 22 is formed by a metal such as SUS. The fiber-reinforced ceramics are formed as follows: Fibers formed from a ceramic material are woven into a cloth, the cloth is coated with a binder-containing ceramic material, and the coated cloth is formed into a cylindrical shape and solidified. Usually, a plurality of ceramic fiber layers are stacked on top of each other. Further, a thermal insulator 23 composed of a porous ceramic material is inserted into a space between the inner cylinder 21 and the outer cylinder 22. The thermal insulator 23 composed of the porous ceramic material may be formed as follows: Fibers are formed from a ceramic material, and the fibers are then formed by a forming suction device so as to conform to the shape of the space between the inner cylinder 21 and the outer cylinder 22.

Examples of ceramic materials for forming the thermal insulator 23 and the inner cylinder 21 include alumina having a purity of 80 to 90.7% and Si-based ceramic materials. In the case where an exhaust gas containing fluorine is treated, it is desirable to use alumina having high corrosion resistance to the exhaust gas. Two UV sensors 25 for detecting flames and a pilot burner PB for ignition in the burner section 2 are provided on the top plate portion (top portion) of the cylindrical member 11 of the burner section 2. The UV sensor 25 is disposed to be inclined with respect to the top portion of the cylindrical member 11 to detect the formed flames from an oblique direction. The reason for this is that flames form swirling flows in the burner section 2 and become small in length with respect to the radial direction. If the UV sensor is provided at an inner circumferential surface side of the burner section 2, when silane ($SiH_4$) or the like is treated, the solid matters such as $SiO_2$ adhere to the inner circumferential surface of the burner section 2, and there is a possibility that the UV sensor cannot detect flames. However, by providing the UV sensor 25 on the top plate portion (top portion) of the burner section 2, it is possible to avoid the problem that the UV sensor cannot detect flames due to the adhesion of the solid matters. Further, in order to treat a PFC gas which is difficult to decompose, a high temperature of 1300° C. or higher is needed, and thus there is a possibility that pipes are corroded by heat. However, as described above, high-temperature corrosion can be avoided by installing the UV sensor 25 and the pilot burner PB on the top plate portion of the burner section 2.

Further, a first scraper 30 is disposed so as to be vertically movable in the burner section 2. The scraper 30 comprises a substantially cylindrical scraper body (scraper plate) 30*a* and a rod-like arm 30*b* extending upwardly from the scraper body (scraper plate) 30*a*, and a saw-like scraping portion 30*c* is formed at the lower end of the substantially cylindrical scraper body 30*a*. The rod-like arm 30*b* passes through the cylindrical member 11 and the outer cylinder 12 and extends upwardly, and an air cylinder 31 is coupled to the upper portion of the arm 30*b*. Then, by actuating the air cylinder 31, the scraper 30 is lowered to scrape off the solid matters containing silica ($SiO_2$) deposited on the inner wall surface of the burner section 2, i.e., on the inner circumferential surface of the cylindrical member 11. The air cylinder 31 is fixed to the top plate portion (top portion) of the outer cylinder 12.

On the other hand, a second scraper 40 is disposed so as to be vertically movable in the combustion chamber 3. The second scraper 40 comprises a substantially cylindrical scraper body (scraper plate) 40*a* and a rod-like arm 40*b* extending downwardly from the scraper body 40*a*, and a saw-like scraping portion 40*c* is formed at the upper end of the substantially cylindrical scraper body (scraper plate) 40*a*. The rod-like arm 40*b* passes through a cooling section (not shown) located below the combustion treatment chamber 1 and extends outwardly, and is coupled to an air cylinder (not shown). Then, by actuating the air cylinder, the second scraper 40 is raised to scrape off the solid matters containing silica ($SiO_2$) deposited on the inner wall surface of the combustion chamber 3, i.e., on the inner circumferential surface of the inner cylinder 21. The solid matters deposited on the inner wall surface of the combustion chamber 3 are softer than the solid matters deposited on the inner wall surface of the burner section 2 and are easier to be scraped off, and thus the scraping portion 40*c* of the scraper 40 may have a flat shape without saw teeth.

Next, operation of the above combustion treatment chamber 1 will be described.

First, a mixture gas of a fuel gas (fuel) and an oxidizing gas (for example, oxygen) is introduced into the mixture gas chamber 20 and is retained therein, and is blown off from the main burner MB comprising a plurality of nozzles 16 formed in the cylindrical member 11 toward the space S so as to produce the swirling flows. Then, the mixture gas is ignited by the pilot burner PB, and the swirling flows of flames (swirling flames) are formed along the inner circumferential surface of the cylindrical member 11.

Here, the mixture gas forms the swirling flames, and the swirling flames have the feature that they can be stably combusted over a wide range of equivalence ratios. Specifically, because the swirling flames swirl intensely, the swirling flames supply heat and radicals to each other to enhance flame stabilizing properties. Accordingly, even at such a small equivalence ratio that normally uncombusted gas may be generated or quenching may occur, the mixture gas can be combusted stably without generating uncombusted gas and without causing pulsating combustion even in the vicinity of the equivalence ratio of 1.

On the other hand, the exhaust gas G1 to be treated is blown off toward the space S from the exhaust gas introduction pipes 14 which open on the lower surface of the top plate portion of the cylindrical member 11. The exhaust gas G1 blown off mixes with the swirling flames of the mixture gas and is combusted. At this time, because the mixture gas is blown off from the main burner MB, i.e., all the nozzles 16 constituting the main burner MB provided in the circumferential direction of the cylindrical member 11 so as to swirl intensely in one direction downstream of the nozzles, all the mixture gas mixes sufficiently with the flames. Thus, combustion efficiency becomes very high.

Further, the flames from the main burner MB comprising a plurality of nozzles 16 are blown off in a swirling state, and the air ejected from the air nozzles 15 is also swirling. Therefore, the air flows mix with the flames to further accelerate the swirling flows of the flames, thus forming intense swirling flames. In this manner, when the swirling flames are formed, the pressure of the gas flow in the central part of the swirl is lowered, and thus self-circulating flows that flow backward from the forward ends of the flames toward the exhaust gas introduction pipes 14 and the main burner MB occur in the central part of the swirl. Then, the circulating flows mix with the flames from the main burner MB and the combustion gas, thereby suppressing the formation of NOx.

Oxygen contained in the air ejected from the air nozzles 15 is given to the flames to form secondary oxidizing flames. The exhaust gas is oxidatively decomposed by the oxidizing flames.

A plurality of nozzles 16 constituting the main burner MB may be provided so as to open in the tangential direction to the cylindrical member 11 as viewed from above and open obliquely downward in a vertical plane. This arrangement also allows flames to form spiral swirling flows toward the downstream side of the burner section 2.

The swirling flows of the flames formed in the burner section 2 are retained also in the combustion chamber 3 to combust the exhaust gas, which has not been combusted completely but has been left, preliminarily or supplementarily. In the combustion chamber 3, the ceramic material constituting the inner cylinder 21 has excellent heat resistance and corrosion resistance. Therefore, wear due to heat and corrosion is minimized. In addition, cracking caused by thermal stress is prevented because the ceramic material is reinforced with fibers. Accordingly, the inner cylinder 21 can be used for a long period of time. Moreover, because there is no catalytic effect as occurred in the case of a metal, the formation of thermal NOx is suppressed even when the temperature in the combustion chamber 3 becomes high. Even when a halogen-based gas is subjected to decomposition treatment, it is possible to suppress corrosion and etching of the inner cylinder 21 under high temperature by a halogen gas (HCl, HF or the like) generated from the decomposition treatment.

When combustion of the gas containing silicon component is continued, silica as a by-product is deposited on the inner walls of the burner section 2 and the combustion chamber 3. Because the downward swirling flows are formed, the deposited silica may grow toward the central portion of the chamber at the locations, particularly below the air nozzles 15 and the nozzles 16 of the main burner MB to block the flow of the exhaust gas. In order to remove the deposited solid matters, as described above, in the combustion treatment chamber 1, the scraper 30 is operated at a predetermined timing by actuating the air cylinder 31 during combustion treatment of the exhaust gas, i.e., combustion decomposition of the exhaust gas, thereby scraping off the solid matters containing silica ($SiO_2$) deposited on the inner wall surface of the burner section 2, i.e., on the inner circumferential surface of the cylindrical member 11. In this manner, by removing the deposited solid matters even when combustion decomposition of the exhaust gas is carried out, prolonged continuous operation of the exhaust gas treatment apparatus becomes possible. At this time, the scraper body 30*a* passes transversely across the respective nozzles 16 constituting the main burner MB. In this case, if the mixture gas of the fuel gas and oxygen is supplied from the main burner MB into the burner section 2, as described in [Technical Problem], blowing flow velocity of the mixture gas from the nozzles 16 becomes nonuniform due to hydrodynamic pressure fluctuation or the like in the vicinity of the nozzles 16 of the main burner MB, thus possibly causing a backfire into the main burner pipe.

Therefore, according to the present invention, in order to prevent the backfire into the main burner MB and the main burner pipe from occurring even if the scraper 30 is operated during combustion treatment (combustion decomposition) of the exhaust gas, the following measures are taken.

When the scraper 30 in the burner section 2 is operated, the mixture gas of the fuel gas and the oxidizing gas supplied to the main burner MB is adjusted outside combustion range.

The mixture gas of the fuel gas and the oxidizing gas cannot be combusted if the concentration of the fuel gas is too low or too high. The limit of concentration of the fuel gas contained in the mixture gas which can be combusted is referred to as combustion limit. The combustion limit of low concentration of the fuel gas is referred to as lower limit, and the combustion limit of high concentration of the fuel gas is referred to as upper limit. When the concentration of the fuel gas is within the range between the lower limit and the upper limit, the fuel gas is combusted, and hence this concentration range is referred to as combustion range. The range which is not included in the combustion range is referred to as outside combustion range.

When the composition of the mixture gas of the fuel gas and the oxidizing gas is within the combustion range, the backfire into the main burner MB and the main burner pipe may occur. When the composition of the mixture gas supplied to the main burner MB is outside the combustion range, the backfire does not occur.

As described above, the backfire may occur within the combustion range, and hence it is necessary to make the composition of the mixture gas outside the combustion range. When propane is used as a fuel gas, consideration will be given below to the relationship between the composition of the mixture gas and the combustion range (outside the combustion range). It is known that in the case of using oxygen as an oxidizing gas, propane component (%) with respect to the mixture gas is 2% at the lower limit of combustion and 40% at the upper limit of combustion, and in the case of using air as an oxidizing gas, propane component (%) with respect to the mixture gas is 2% at the lower limit of combustion and 10% at the upper limit of combustion. The combustion range of the propane component (%) with respect to the mixture gas in the case of using oxygen as an oxidizing gas becomes narrower than that in the case of using air as an oxidizing gas. For example, in the case where the fuel gas is propane and propane/(propane+oxidizing gas)=15%, the case where the oxidizing gas is $O_2$ becomes within the combustion range, but the case where the oxidizing gas is air becomes outside the combustion range.

In the case where the fuel gas (fuel) comprises other gases such as utility gas, natural gas or the like, the components of the mixture gas which become outside the combustion range should be determined in the same manner as the case where the fuel gas is propane. Specifically, the components of the mixture gas can be adjusted on the basis of the relationship between the composition of the mixture gas of the fuel gas and the oxidizing gas (oxygen and air) and the combustion range (outside the combustion range).

On the basis of the above theory, when the scraper 30 is operated during combustion treatment of the exhaust gas, the mixture gas of the fuel gas and the oxidizing gas supplied to the main burner MB is adjusted outside the combustion range. However, in the case where the mixture gas of the fuel gas and the oxidizing gas supplied to the main burner MB is adjusted outside the combustion range, the following new problems arise.

1) The Mixture Gas Should Have Good Ignitionability.

It is necessary to ignite the mixture gas immediately after the mixture gas of the fuel gas and the oxidizing gas which is outside the combustion range is blown off from the main burner MB. Specifically, it is necessary for the mixture gas to have good ignitionability.

2) Sufficient Amount of Oxygen Should be Supplied to Combust the Mixture Gas Completely.

Because oxygen is scarce in the mixture gas which is outside the combustion range, it is necessary to supplement oxygen after the mixture gas is blown off from the main burner MB so as to combust the mixture gas completely.

3) The Flame Retention Capacity is Equivalent to that in Normal Operation.

It is necessary that the retention capacity of flames formed by blowing off the mixture gas from the main burner MB is equivalent to that in normal operation (normal exhaust gas treatment when the scraper is not in operation).

In order to solve the above problems 1) to 3), according to the present invention, the following measures are taken.

(1) In the case where the exhaust gas to be treated is a gas (PFC gas such as $CF_4$, $C_2F_6$ or the like) which is difficult to combust:

i) At the time of normal operation (normal exhaust gas treatment when the scraper is not in operation), a mixture gas produced by premixing a fuel gas and oxygen is supplied from the main burner MB into the burner section 2. The mixture gas is outside the combustion range. Then, air is supplied from the air nozzles 15 into the burner section 2 to form swirling flows.

ii) During operation of the scraper, a mixture gas produced by premixing a fuel gas and air is supplied from the main burner MB into the burner section 2. In this case, because the mixture gas is outside the combustion range, oxygen ($O_2$) which is scarce in the mixture gas is supplied from the air nozzles 15 for forming the swirling flows. Specifically, by making the mixture gas in the main burner MB and the main burner pipe outside the combustion range, a backfire into the main burner MB and the main burner pipe can be prevented. Then, in order to ensure ignitionability of the mixture gas and flame retention capacity and to prevent treatment performance of the exhaust gas from lowering, oxygen is additionally supplied to the air nozzles 15 to compensate for oxygen which is scarce, and is then supplied from the air nozzles 15 into the burner section 2. In this case, air is also supplied from the air nozzles 15 into the burner section 2 to form swirling flows. In this manner, by supplementing oxygen, during normal operation and during operation of the scraper, the ratio of flow rate of the exhaust gas, the fuel gas, oxygen and air supplied to the combustion treatment chamber 1 is not changed as a whole.

(2) In the case where the exhaust gas to be treated is a gas (silane-based gas such as $SiH_4$ or the like) which is easily combusted:

i) At the time of normal operation (normal exhaust gas treatment when the scraper is not in operation), a mixture gas produced by premixing a fuel gas and oxygen is supplied from the main burner MB into the burner section 2. The mixture gas is outside the combustion range. Then, air is supplied from the air nozzles 15 into the burner section 2 to form swirling flows.

ii) During operation of the scraper, a mixture gas produced by premixing a fuel gas and air is supplied from the main burner MB into the burner section 2. In this case, although the combustion gas is outside the combustion range, because the exhaust gas is a gas which is easily combusted, it is unnecessary to supplement oxygen from the air nozzles 15. Thus, from the air nozzles 15, in the same manner as the normal operation, air is supplied into the burner section 2 to form swirling flows. The mixture gas blown off from the main burner MB mixes with air supplied from the air nozzles and becomes within the combustion range, and is then combusted.

(3) Irrespective of the kind of exhaust gas to be treated, during operation of the scraper, a pilot light is supplied from the pilot burner. Thus, during operation of the scraper, a flame is prevented from being extinguished in the burner section 2.

Next, the entire structure of the combustion-type exhaust gas treatment apparatus having the above means (1) to (3) will be described with reference to FIG. 2.

Figure 2:
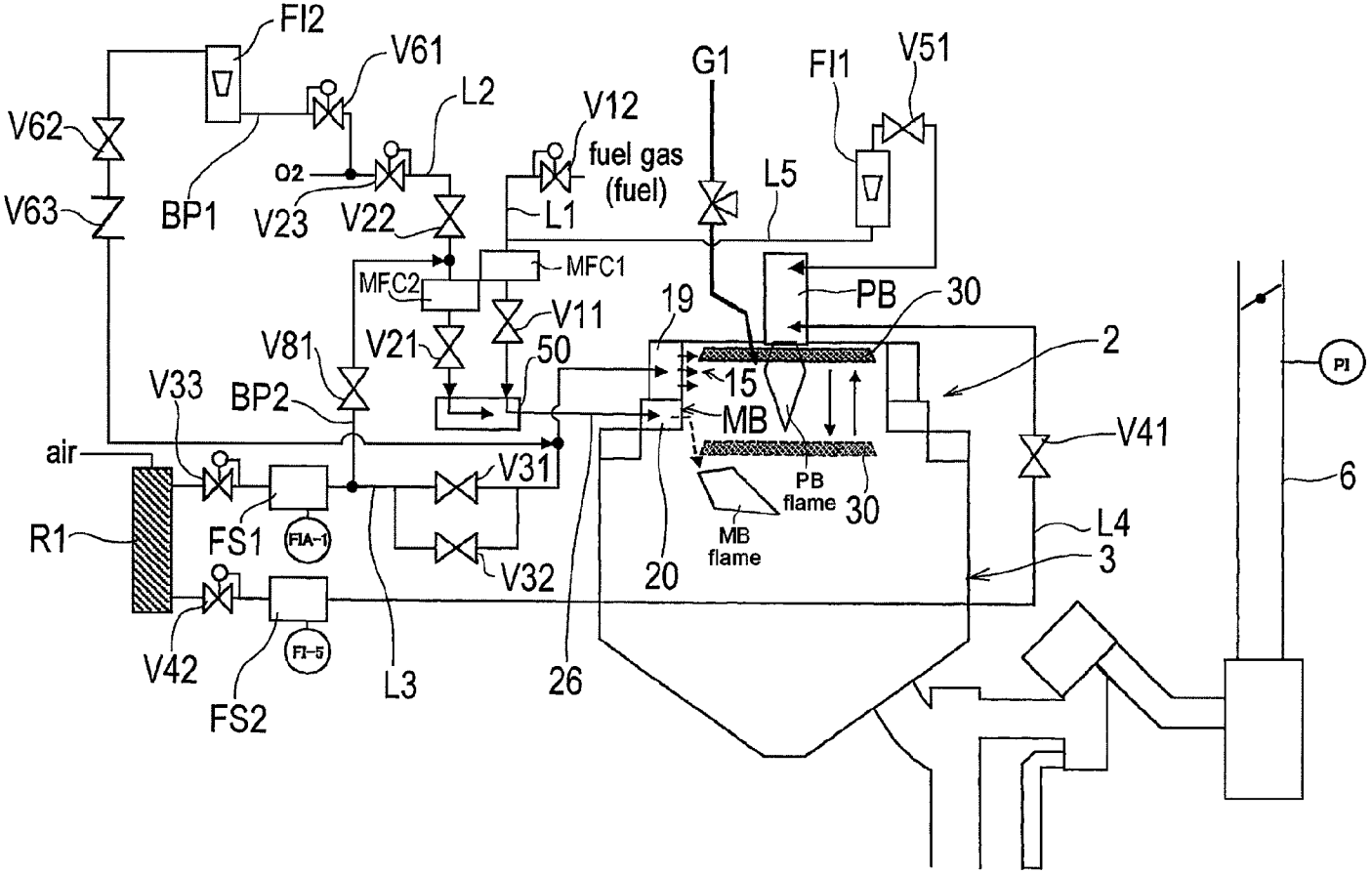
FIG. 2 is a schematic view showing the entire structure of the combustion-type exhaust gas treatment apparatus according to the present invention.

As shown in FIG. 2, the mixture gas chamber 20 of the burner section 2 is connected to an ejector (premixer) 50 by a mixture gas supply pipe 26. Then, a fuel gas supply line L1 and an oxygen supply line L2 are connected to the ejector 50. In the fuel gas supply line L1, an opening and closing valve V11, a massflow controller MFC1, and a pressure regulating valve V12 are provided in that order from the ejector 50 to the upstream side, and the upstream end of the fuel gas supply line L1 is connected to a fuel gas supply source (fuel supply source). In the oxygen supply line L2, an opening and closing valve V21, a massflow controller MFC2, an opening and closing valve V22, and a pressure regulating valve V23 are provided in that order from the ejector 50 to the upstream side, and the upstream end of the oxygen supply line L2 is connected to an oxygen supply source.

Further, an air supply line L3 is connected to the air chamber 19 of the burner section 2. In the air supply line L3, opening and closing valves V31, V32, a flow rate sensor FS1, a pressure regulating valve V33, and a header R1 are provided in that order from the air chamber 19 to the upstream side, and the upstream end of the air supply line L3 is connected to an air supply source. A pilot burner air supply line L4 is connected to the pilot burner PB. In the pilot burner air supply line L4, an opening and closing valve V41, a flow rate sensor FS2, a pressure regulating valve V42, and the header R1 are provided in that order from the pilot burner PB to the upstream side. The pressure regulating valves V33, V42 are set to allow a pressure of air supplied from the air supply source to be adjustable in two stages, i.e., a pressure for a primary air (for example, 0.37 MPa) and a pressure for a pilot burner (for example, 0.45 MPa).

A pilot burner fuel gas supply line L5 is connected to the pilot burner PB. In the pilot burner fuel gas supply line L5, an opening and closing valve V51 and a flow meter FI1 are provided in that order from the pilot burner PB to the upstream side. Then, the upstream end of the pilot burner fuel gas supply line L5 is connected to the fuel gas supply line L1.

On the other hand, an oxygen supply bypass line BP1 branched from the oxygen supply line L2 is provided, and the downstream end of the oxygen supply bypass line BP1 is connected to the air supply line L3. The oxygen supply bypass line BP1 is branched from a piping portion which connects the oxygen supply source and the control valve V23 in the oxygen supply line L2, and is connected to a piping portion which connects the opening and closing valve V31 and the air chamber 19 in the air supply line L3. In the oxygen supply bypass line BP1, a pressure regulating valve V61, a flow meter FI2, an opening and closing valve V62, and a check valve V63 are provided in that order from the upstream side to the downstream side. Further, an air supply bypass line BP2 branched from the air supply line L3 is provided, and an opening and closing valve V81 is provided in the air supply bypass line BP2. Then, the downstream end of the air supply bypass line BP2 is connected to the oxygen supply line L2. The air supply bypass line BP2 is branched from a piping portion which connects the flow sensor FS1 and the opening and closing valve V31 in the air supply line L3, and is connected to a piping portion which connects the opening and closing valve V22 and the massflow controller MFC2 in the oxygen supply line L2.

Figure 3:
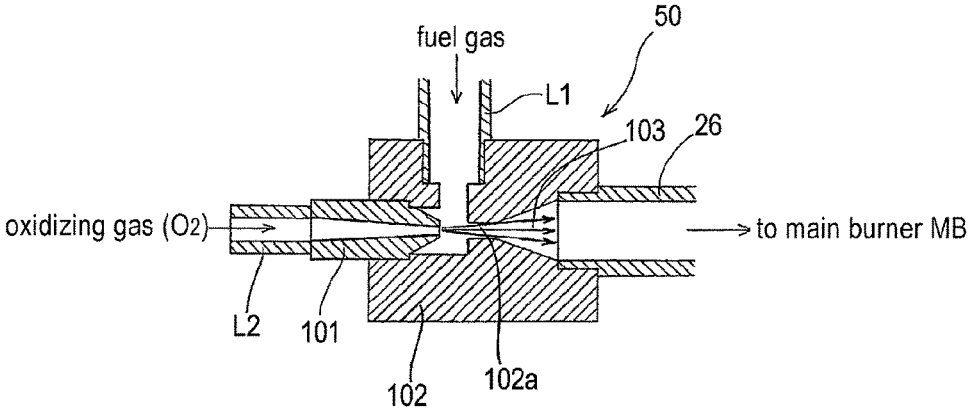
FIG. 3 is a cross-sectional view showing a detailed structure of an ejector shown in FIG. 2.

FIG. 3 is a cross-sectional view showing a detailed structure of the ejector 50 shown in FIG. 2. As shown in FIG. 3, the ejector 50 comprises a nozzle unit 101 for ejecting an oxidizing gas (for example, oxygen) and a diffuser unit 102 having a diffuser 102*a* therein. The oxygen supply line L2 is connected to the nozzle unit 101, and the fuel gas supply line L1 and the mixture gas supply pipe 26 are connected to the diffuser unit 102. In the ejector 50, the oxidizing gas (for example, oxygen) is ejected at a high speed from the nozzle unit 101 to lower a pressure in the diffuser 102*a*, and thus the fuel gas is drawn in from the fuel gas supply line L1 and the fuel gas and the oxidizing gas (for example, oxygen) are premixed. Then, the premixed gas decreases its speed and increases its pressure in an expanded portion 103 connected to the diffuser 102*a*, and the mixture gas of the fuel gas and the oxidizing gas is discharged to the mixture gas supply pipe 26.

Next, exhaust gas treatment process in the combustion-type exhaust gas treatment apparatus constructed as shown in FIG. 2 will be described.

(1) In the case where the exhaust gas to be treated is a gas which is difficult to combust:

i) At the time of normal operation (normal exhaust gas treatment when the scraper is not in operation), the fuel gas is supplied from the fuel gas supply source to the ejector 50 through the fuel gas supply line L1, and oxygen is supplied from the oxygen supply source to the ejector 50 through the oxygen supply line L2. At this time, the mass flow rate of the fuel gas is accurately controlled by the massflow controller MFC1, and the fuel gas can be supplied to the ejector 50 at a desired flow rate. Further, the mass flow rate of oxygen is accurately controlled by the massflow controller MFC2, and oxygen can be supplied to the ejector 50 at a desired flow rate. The fuel gas and oxygen are premixed by the ejector 50, and a mixture gas is supplied to the mixture gas chamber 20 through the mixture gas supply pipe 26. Then, the mixture gas is blown off from the main burner MB into the burner section 2. Because the mixture gas is within the combustion range, the mixture gas is combusted when the mixture gas is blown off from the main burner MB, thus forming swirling flows of flames (swirling flames). Because air ejected from the air nozzles 15 is also swirling, this air flow mixes with the flames of the main burner MB to further accelerate the swirling flows of the flames, thus forming intense swirling flames.

On the other hand, the exhaust gas G1 to be treated is supplied from the exhaust gas introduction pipes 14 into the burner section 2, and is then mixed with the swirling flames of the mixture gas and combusted. The swirling flows of the flames (swirling flames) formed in the burner section 2 is retained also in the combustion chamber 3, and the exhaust gas which has not been combusted completely but has been left in the burner section 2 is combusted preliminarily and supplementarily.

ii) During operation of the scraper, the fuel gas is supplied from the fuel gas supply source to the ejector 50 through the fuel gas supply line L1, and air is supplied form the air supply source to the ejector 50 through the air supply bypass line BP2 branched from the air supply line L3. At this time, the mass flow rate of the fuel gas is accurately controlled by the massflow controller MFC1, and the fuel gas can be supplied to the ejector 50 at a desired flow rate. Further, the mass flow rate of air is accurately controlled by the massflow controller MFC2, and air can be supplied to the ejector 50 at a desired flow rate. The fuel gas and air are premixed by the ejector 50, and a mixture gas is supplied to the mixture gas chamber 20 through the mixture gas supply pipe 26. Then, the mixture gas is blown off from the main burner MB into the burner section 2. Because the mixture gas is poor in oxygen and is outside the combustion range, the mixture gas is not combusted when it is blown off from the main burner MB. In this manner, by making the mixture gas in the main burner MB and the main burner pipe outside the combustion range, a backfire into the main burner MB and the main burner pipe can be prevented. Then, in order to ensure ignitionability of the mixture gas and flame retention capacity and to prevent treatment performance of the exhaust gas from lowering, oxygen which is scarce is supplemented. Therefore, oxygen is supplied from the oxygen supply source to the air nozzles 15 through the oxygen supply bypass line BP1. The flow rate of oxygen supplied to the air nozzles 15 is measured by the flow meter FI2 and is adjusted. At this time, air is simultaneously supplied to the air nozzles 15 through the air supply line L3. The flow rate of air supplied to the air nozzles 15 is measured by the flow rate sensor FS1 and is adjusted. In this manner, a mixture gas of oxygen and air is ejected from the air nozzles 15 to form swirling flows of the mixture gas in the burner section 2, and this mixture gas is mixed with the mixture gas (mixture gas of the fuel gas and air) blown off from the main burner MB. As a result, a mixture gas of the fuel gas, oxygen and air becomes within the combustion range and is thus immediately combusted to form flames.

On the other hand, the exhaust gas G1 to be treated is supplied from the exhaust gas introduction pipes 14 into the burner section 2, and is then mixed with the swirling flames of the mixture gas and combusted. The swirling flows of the flames (swirling flames) formed in the burner section 2 is retained also in the combustion chamber 3, and the exhaust gas which has not been combusted completely but has been left in the burner section 2 is combusted preliminarily and supplementarily.

The premixing of air (premixing of fuel gas and air) is performed before operation of the scraper 40 and is continued after operation of the scraper 40. Specifically, the premixing of air is performed for a predetermined time before operation of the scraper 40, during operation of the scraper 40, and for a predetermined time after operation of the scraper 40. By actuating the air cylinder 41 (see FIG. 1), the scraper 40 is lowered from a standby position (position shown by solid lines in FIG. 2) to a position slightly below the lower end of the burner section 2 (position shown by dotted lines in FIG. 2), and is then raised.

(2) In the case where the exhaust gas to be treated is a gas which is easily combusted:

i) At the time of normal operation (normal exhaust gas treatment when the scraper is not in operation), the fuel gas is supplied from the fuel gas supply source to the ejector 50 through the fuel gas supply line L1, and oxygen is supplied from the oxygen supply source to the ejector 50 through the oxygen supply line L2. At this time, the mass flow rate of the fuel gas is accurately controlled by the massflow controller MFC1, and the fuel gas can be supplied to the ejector 50 at a desired flow rate. Further, the mass flow rate of oxygen is accurately controlled by the massflow controller MFC2, and oxygen can be supplied to the ejector 50 at a desired flow rate. The fuel gas and oxygen are premixed by the ejector 50, and a mixture gas is supplied to the mixture gas chamber 20 through the mixture gas supply pipe 26. Then, the mixture gas is blown off from the main burner MB into the burner section 2. Because the mixture gas is within the combustion range, the mixture gas is combusted when the mixture gas is blown off from the main burner MB, thus forming swirling flows of flames (swirling flames). Because air ejected from the air nozzles 15 is also swirling, this air flow mixes with the flames of the main burner MB to further accelerate the swirling flows of the flames, thus forming intense swirling flames.

On the other hand, the exhaust gas G1 to be treated is supplied from the exhaust gas introduction pipes 14 into the burner section 2, and is then mixed with the swirling flames of the mixture gas and combusted. The swirling flows of the flames (swirling flames) formed in the burner section 2 is retained also in the combustion chamber 3, and the exhaust gas which has not been combusted completely but has been left in the burner section 2 is combusted preliminarily and supplementarily.

ii) During operation of the scraper, the fuel gas is supplied from the fuel gas supply source to the ejector 50 through the fuel gas supply line L1, and air is supplied form the air supply source to the ejector 50 through the air supply bypass line BP2 branched from the air supply line L3. At this time, the mass flow rate of the fuel gas is accurately controlled by the massflow controller MFC1, and the fuel gas can be supplied to the ejector 50 at a desired flow rate. Further, the mass flow rate of air is accurately controlled by the massflow controller MFC2, and air can be supplied to the ejector 50 at a desired flow rate. The fuel gas and air are premixed by the ejector 50, and a mixture gas is supplied to the mixture gas chamber 20 through the mixture gas supply pipe 26. Then, the mixture gas is blown off from the main burner MB into the burner section 2. Because the mixture gas is poor in oxygen and is outside the combustion range, the mixture gas is not combusted when it is blown off from the main burner MB. In this manner, by making the mixture gas in the main burner MB and the main burner pipe outside the combustion range, a backfire into the main burner MB and the main burner pipe can be prevented. Because the exhaust gas is a gas which is easily combusted, it is not necessary to supplement oxygen from the air nozzles 15. Therefore, air is supplied from the air nozzles 15 into the burner section 2 in the same manner as the normal operation. Accordingly, air is ejected from the air nozzles 15 to form swirling flows of air in the burner section 2, and is mixed with the mixture gas (mixture gas of fuel gas and air) blown off from the main burner MB. As a result, the mixture gas is supplemented with oxygen, and becomes within the combustion range and is immediately combusted to form flames.

On the other hand, the exhaust gas G1 to be treated is supplied from the exhaust gas introduction pipes 14 into the burner section 2, and is then mixed with the swirling flames of the mixture gas and combusted. The swirling flows of the flames (swirling flames) formed in the burner section 2 is retained also in the combustion chamber 3, and the exhaust gas which has not been combusted completely but has been left in the burner section 2 is combusted preliminarily and supplementarily. The operation of the scraper 40 is performed in the same manner as the above-mentioned (1).

(3) In any of the case where the exhaust gas to be treated is a hardly combustible gas and the case where the exhaust gas to be treated is an easily combustible gas, during combustion treatment of the exhaust gas and during operation of the scraper 40, the fuel gas is supplied from the fuel gas supply source to the pilot burner PB through the pilot burner fuel gas supply line L5. Specifically, irrespective of the kind of exhaust gas to be treated, during operation of the scraper, a pilot light is supplied from the pilot burner. Thus, during operation of the scraper, a flame is prevented from being extinguished.

Ignition of the pilot burner PB at the time of starting the exhaust gas treatment apparatus is performed in the same manner as the conventional exhaust gas treatment apparatus.

The present inventors have repeatedly conducted the exhaust gas treatment process in the combustion-type exhaust gas treatment apparatus constructed as shown in FIG. 2, and found that in some cases, during operation of the scraper, a pilot light of the pilot burner PB is extinguished and flames in the burner section 2 are extinguished.

The present inventors have conducted various experiments and analyzed experimental results and ascertained that because a fuel is supplied to the pilot burner PB only by a supply pressure (for example, 2.8 kPa) of the fuel gas supply source, the pilot burner flame is easily influenced by pressure fluctuation downstream of the pilot burner and the flame is extinguished to lose a pilot light. Further, the present inventors have ascertained that in the main burner MB, because the fuel gas is drawn in by the ejector, the flames of the main burner MB are insusceptible to pressure fluctuation.

Therefore, according to the present invention, in order to stabilize the pilot burner flame and to prevent the pilot burner flame from being extinguished, the following measures are taken.

(1) An ejector mechanism is provided in the pathway for supplying the fuel gas to the pilot burner.

(2) A massflow controller is provided in the pilot burner fuel gas supply line.

Next, the combustion-type exhaust gas treatment apparatus having the above means (1) and (2) will be described with reference to FIG. 4.

Figure 4:
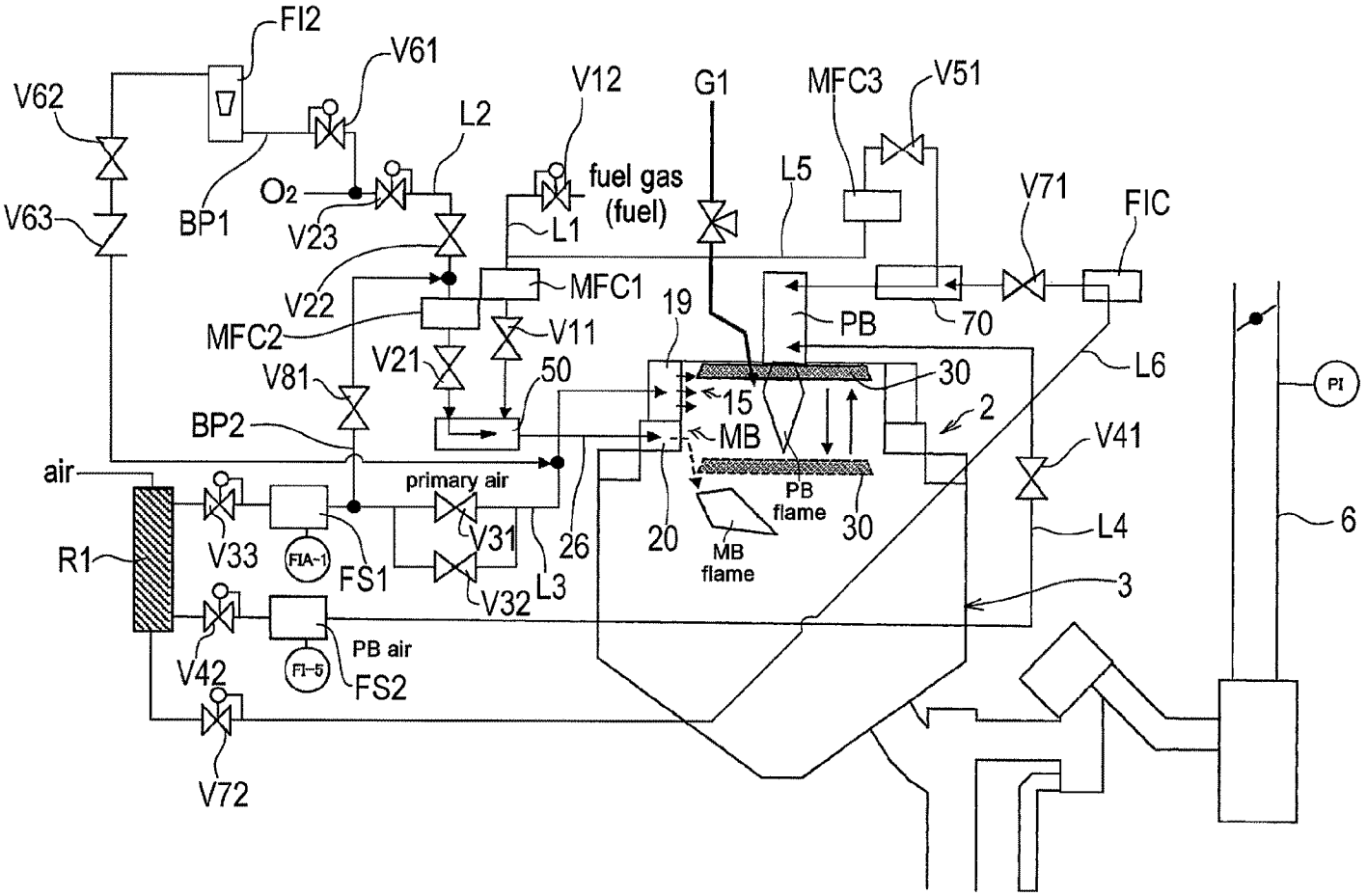
FIG. 4 is a schematic view showing the combustion-type exhaust gas treatment apparatus having an ejector mechanism and a massflow controller.

The combustion-type exhaust gas treatment apparatus shown in FIG. 4 is configured such that an ejector mechanism is added to the combustion-type exhaust gas treatment apparatus shown in FIG. 2 and a massflow controller is provided in the pilot burner fuel gas supply line L5.

As shown in FIG. 4, the pilot burner PB is connected to a pilot burner ejector 70. Then, the pilot burner fuel gas supply line L5 and an air supply line L6 are connected to the pilot burner ejector 70. In the pilot burner fuel gas supply line L5, an opening and closing valve V51 and a massflow controller MFC3 are provided in that order from the pilot burner ejector 70 to the upstream side. The upstream end of the pilot burner fuel gas supply line L5 is connected to the fuel gas supply line L1. In the air supply line L6, an opening and closing valve V71, a flow rate controller FIC and a pressure regulating vale V72 are provided in that order from the pilot burner ejector 70 to the upstream side. The pilot burner ejector 70 has the same structure as the ejector 50 shown in FIG. 3, and thus illustration of the ejector 70 is omitted. Other structures in the combustion-type exhaust gas treatment apparatus shown in FIG. 4 are the same as those in the combustion-type exhaust gas treatment apparatus shown in FIG. 2.

In the combustion-type exhaust gas treatment apparatus shown in FIG. 4, air is supplied from the air supply source to the pilot burner ejector 70 through the air supply line L6, and the fuel gas is supplied from the fuel gas supply source to the pilot burner ejector 70 through the pilot burner fuel gas supply line L5. In the pilot burner ejector 70, air is ejected at a high speed to generate negative pressure, thereby drawing in the fuel gas. The source pressure of the fuel gas supply source is, for example, about 2.8 kPa and is low. However, the fuel gas is pressurized by the pilot burner ejector 70, and thus the fuel gas discharged from the pilot burner ejector 70 and supplied to the pilot burner PB becomes high pressure of, for example, about 20 kPa. Therefore, the pilot burner flame is insusceptible to pressure fluctuation downstream of the pilot burner. Concurrently, the mass flow rate of the fuel gas is accurately controlled by the massflow controller MFC3, and the fuel gas can be supplied to the pilot burner PB at a desired mass flow rate. Further, the flow rate of air supplied to the pilot burner ejector 70 is accurately controlled by the flow rate controller FIC, and a desired negative pressure can be produced in the pilot burner ejector 70.

In this manner, by providing the ejector mechanism in the pathway for supplying the fuel gas to the pilot burner PB, the pressure of the fuel gas ejected from the pilot burner PB can be raised, and by providing the massflow controller MFC3 in the pilot burner fuel gas supply line L5, the fuel gas can be accurately supplied to the pilot burner PB at a desired mass flow rate. Accordingly, the flame of the pilot burner can be stabilized. Therefore, during operation of the scraper 40, the pilot burner flame is not extinguished and the flame is prevented from being extinguished in the burner section 2.

Next, the two scrapers 30, 40 in the combustion-type exhaust gas treatment apparatus according to the present invention will be described with reference to FIGS. 5 through 7.

Figure 5:
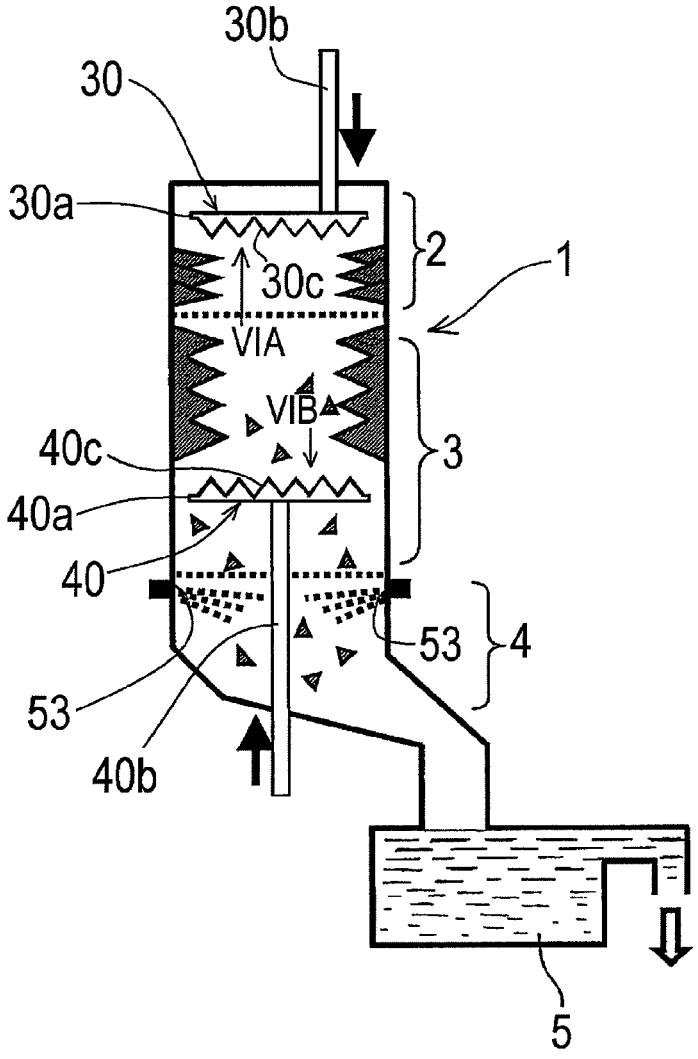
FIG. 5 is a schematic cross-sectional view showing the relationship between the two scrapers and the combustion treatment chamber.

FIG. 5 is a schematic cross-sectional view showing the relationship between the two scrapers 30, 40 and the combustion treatment chamber 1. As shown in FIG. 5, the scraper 30 is disposed so as to be vertically movable in the burner section 2. The scraper 30 comprises a substantially cylindrical scraper body 30*a* and a rod-like arm 30*b* extending upwardly from the scraper body 30*a*, and a saw-like scraping portion 30*c* is formed at the lower end of the substantially cylindrical scraper body 30*a*. The air cylinder 31 (see FIG. 1) is coupled to the upper portion of the rod-like arm 30*b*. By actuating the air cylinder 31, the scraper 30 is lowered to scrape off the solid matters containing silica ($SiO_2$) deposited on the inner wall surface of the burner section 2.

Further, a second scraper 40 is disposed so as to be vertically movable in the combustion chamber 3. The second scraper 40 comprises a substantially cylindrical scraper body 40*a* and a rod-like arm 40*b* extending downwardly from the scraper body 40*a*, and a saw-like scraping portion 40*c* is formed at the upper end of the substantially cylindrical scraper body 40*a*. The rod-like arm 40*b* passes through the cooling section 4 located below the combustion treatment chamber 1 and extends outwardly, and is coupled to an air cylinder (not shown). Then, by actuating the air cylinder, the second scraper 40 is raised to scrape off the solid matters containing silica ($SiO_2$) deposited on the inner wall surface of the combustion chamber 3. As described above, the scraping portion 40*c* of the scraper 40 may have a flat shape without saw teeth.

As shown in FIG. 5, the scraper 30 finishes a single action by a single reciprocating motion in which the scraper 30 is lowered from a standby position near the top plate of the burner section 2 to a position slightly below the lower end of the burner section 2 and is then raised. This single action is set to about 10 seconds. The operation frequency of the scraper 30 is set to, for example, once every 15 minutes. In contrast, the second scraper 40 finishes a single action by plural reciprocating motions in which the second scraper 40 performs a single reciprocating motion where the second scraper 40 is raised from a standby position in the cooling section 4 located below the combustion chamber 3 to a predetermined position in the combustion chamber and is then lowered, and then performs a single reciprocating motion where the second scraper 40 is raised again from the standby position to a position higher than the previous raised position and is then lowered. The operation frequency of the scraper 40 is set to be lower than that of the scraper 30. Position sensors (not shown) for detecting respective positions of the scraper body 30*a* and the scraper body 40*a* are provided so that the scraper 30 and the scraper 40 are not left as they stop half way.

As shown in FIG. 5, the cooling section 4 is provided below the combustion chamber 3. In the cooling section 4, a plurality of nozzles 53 are provided at certain intervals in a circumferential direction, and water is sprayed like a shower from these nozzles 53 toward a central part to cool the exhaust gas and to trap particles in the exhaust gas. Further, a trap 5 for storing drainage water discharged from the cooling section 4 and particles or the like trapped in the drainage water is provided below the cooling section 4. The exhaust gas cooled and cleaned in the cooling section 4 is discharged to the outside of the apparatus through an exhaust duct 6 (see FIG. 2) extending from the sidewall of the cooling section 4.

Figure 6A:
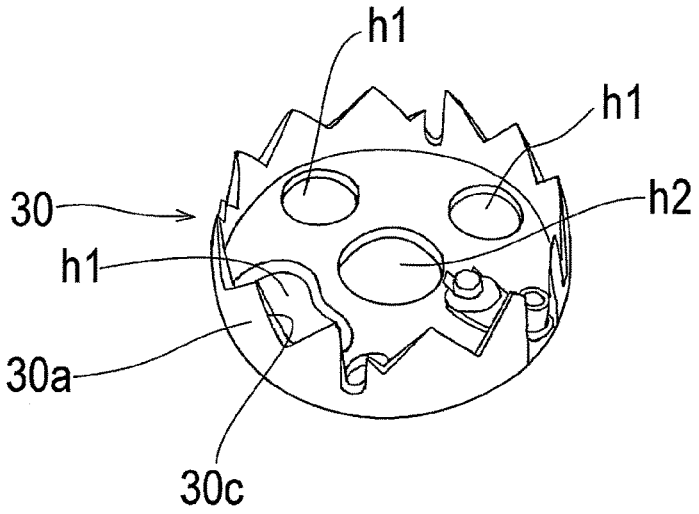
FIG. 6A is a perspective view showing upper and lower scrapers and the perspective view of the first scraper as viewed from VIA direction of FIG. 5.
Figure 6B:
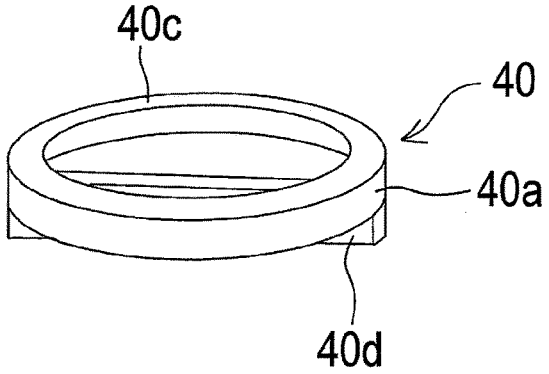
FIG. 6B is a perspective view showing upper and lower scrapers and the perspective view of the second scraper as viewed from VIB direction of FIG. 5.

FIGS. 6A and 6B are perspective views showing the upper and lower scrapers 30 and 40, respectively. FIG. 6A is a perspective view of the scraper 30 as viewed from VIA direction of FIG. 5 and FIG. 6B is a perspective view of the second scraper 40 as viewed from VIB direction of FIG. 5.

As shown in FIG. 6A, the scraper 30 has a substantially cylindrical scraper body 30*a* having a top plate portion, and a saw-like scraping portion 30*c* for scraping the solid matters such as silica is formed on the scraper body 30*a*. Then, three openings h1 for introducing the exhaust gas and an opening h2 for the pilot burner are formed in the top plating portion of the scraper body 30*a*.

As shown in FIG. 6B, the scraper 40 has a ring-shaped scraper body 40*a*, and a saw-like scraping portion 40*c* for scraping the solid matters such as silica is formed at the upper end of the scraper body 40*a*. In the example shown in FIG. 6B, the scraping portion 40*c* is not saw-like but flat. Because the solid matters containing silica adhering to the inner wall of the combustion chamber 3 are softer than the solid matters containing silica adhering to the inner wall of the burner section 2 and is easier to be scraped off, the scraping portion 40*c* of the scraper 40 has a flat shape. At the central part of the ring-shaped scraper body 40*a*, a bar 40*d* extending in a diameter direction of the scraper body 40*a* is provided, and the arm 40*b* (see FIG. 5) is fixed to the bar 40*b*.

Figure 7:
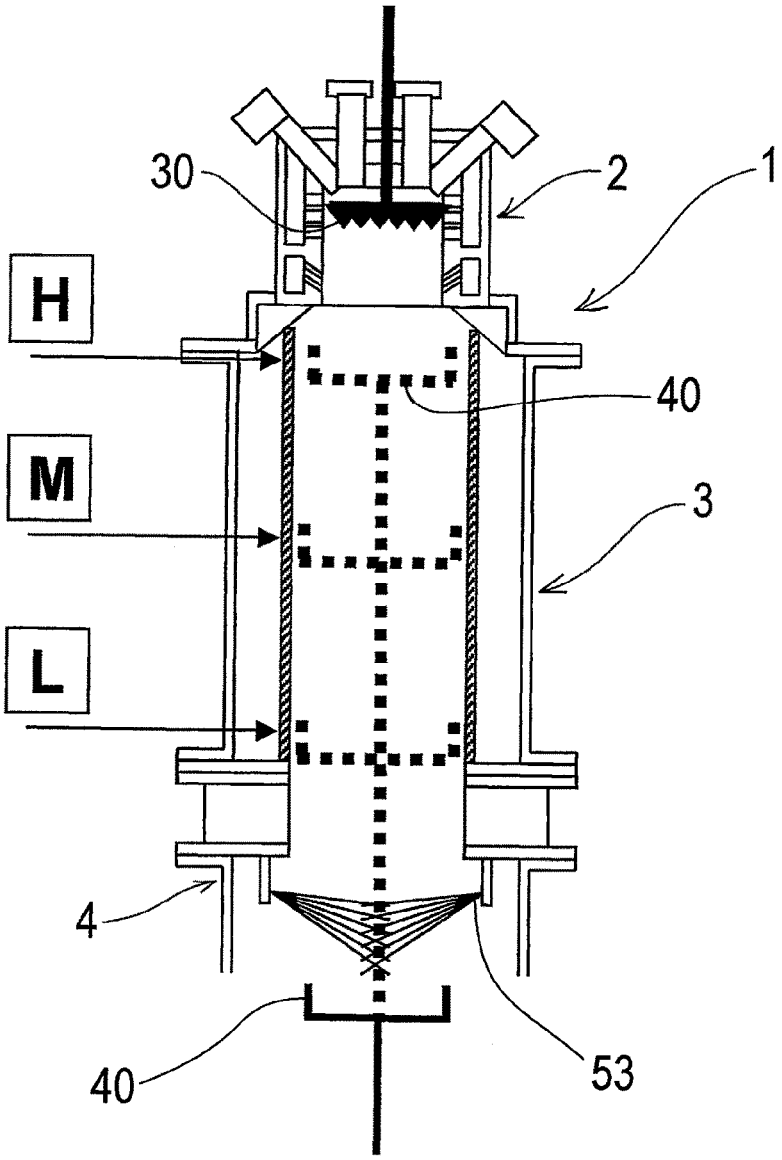
FIG. 7 is a schematic view showing an example of the action of the second scraper.

FIG. 7 is a schematic view showing an example of the action of the second scraper 40. As shown in FIG. 7, the scraper 40 is arranged such that the scraper 40 performs three vertical motions where the scraper 40 moves from a standby position (shown by solid lines) below a primary cooling shower of the cooling section 4 located below the combustion chamber 3 to predetermined positions (L, M, H) in the combustion chamber 3. Specifically, the scraper 40 is raised to the position L and is then returned to the original position (standby position) at the first time, and the scraper 40 is raised to the position M and is then returned to the original position at the second time, and then the scraper 40 is raised to the position H and is then returned to the original position at the third time. A single scraper action finishes by these three vertical motions. This action duration is set to about 20 seconds.

Although certain preferred embodiments of the present invention have been described in detail, it should be understood that various changes and modifications may be made therein without being limited to the above embodiments and within the scope of technical idea of the present invention. In particular, although examples in which a fuel and an oxygen source are premixed in the mixture gas chamber and the mixture gas is supplied are shown in the embodiments, the present invention is not limited to the premixing type as recited in claims 4 to 10 but applicable broadly to the combustion-type exhaust gas treatment apparatus.

INDUSTRIAL APPLICABILITY

The present invention is applicable to a combustion-type exhaust gas treatment apparatus for treating an exhaust gas containing a silane-based gas ($SiH_4$, TEOS or the like), a halogen-based gas ($NF_3$, $ClF_3$, $SF_6$, $CHF_3$ or the like), a PFC gas ($CF_4$, $C_2F_6$ or the like) or the like by combusting and decomposing the exhaust gas to make the exhaust gas harmless.

The invention claimed is:

1. A combustion-type exhaust gas treatment apparatus comprising:

a combustion treatment chamber configured to treat an exhaust gas by combusting and decomposing the exhaust gas;

a main burner configured to form a flame in said combustion treatment chamber by supplying a mixture gas produced by premixing a fuel gas and an oxidizing gas;

a scraper plate configured to scrape off solid matters adhering to an inner wall of said combustion treatment chamber; and gas supply lines having valves for adjusting a composition of the mixture gas such that:

the mixture gas is combustible and supplied to said main burner during the combusting and decomposing of the exhaust gas at a time when said scraper plate is not in operation; and the mixture gas is noncombustible and supplied to said main burner during the combusting and decomposing of the exhaust gas at a time when said scraper plate is in a scraping operation.

2. The combustion-type exhaust gas treatment apparatus according to claim 1, wherein the mixture gas is adjusted to be combustible or noncombustible by changing a component ratio of oxygen in the oxidizing gas.

3. The combustion-type exhaust gas treatment apparatus according to claim 1, wherein the oxidizing gas comprises oxygen or air.

4. A combustion-type exhaust gas treatment apparatus comprising:

a combustion treatment chamber configured to treat an exhaust gas by supplying a fuel, oxygen, and air and by combusting and decomposing the exhaust gas;

a scraper plate configured to scrape off solid matters adhering to an inner wall of said combustion treatment chamber; and gas supply lines having valves for adjusting a mixture of the fuel, oxygen, and air supplied such that:

the fuel and oxygen are premixed so as to be combustible and supplied to said combustion treatment chamber at a time when said scraper plate is not in operation during the combusting and decomposing of the exhaust gas; and the fuel and air are premixed so as to be noncombustible and supplied to said combustion treatment chamber at a time when said scraper plate is in a scraping operation during the combusting and decomposing of the exhaust gas.

5. The combustion-type exhaust gas treatment apparatus according to claim 4, wherein said combustion treatment chamber comprises:

a main burner configured to form a flame in said combustion treatment chamber by supplying a fuel, and a nozzle configured to form a swirling flow by ejecting a gas into said combustion treatment chamber;

wherein a mixture gas produced by premixing the fuel and the oxygen is supplied from said main burner to said combustion treatment chamber and the air is supplied to said nozzle when said scraper plate is not in operation; and wherein a mixture gas produced by premixing the fuel and the air is supplied from said main burner to said combustion treatment chamber and the air and the oxygen are supplied to said nozzle when said scraper plate is in a scraping operation.

6. A combustion-type exhaust gas treatment apparatus comprising:

a combustion treatment chamber configured to combust and decompose an exhaust gas by supplying a fuel, oxygen, and air; and a scraper plate configured to scrape off solid matters adhering to an inner wall of said combustion treatment chamber, wherein said combustion treatment chamber comprises:

a pilot burner configured to ignite at a start of treatment of the exhaust gas;

a main burner for maintaining a flame during the treatment of the exhaust gas to combust and decompose the exhaust gas; and an ejector mechanism in a pathway for supplying the fuel to said pilot burner, said ejector mechanism being configured to raise a pressure of the fuel blown off from the pilot burner to stabilize a flame of the pilot burner;

wherein said combustion treatment chamber and said scraper plate are configured such that:

combustion in said pilot burner is stopped during combusting and decomposing of the exhaust gas in said combustion treatment chamber at a time when said scraper plate is not in operation; and combustion in said pilot burner is maintained during the combusting and decomposing of the exhaust gas in said combustion treatment chamber at a time when said scraper plate is in a scraping operation.

7. The combustion-type exhaust gas treatment apparatus according to claim 6, wherein the fuel and the oxygen are supplied from said main burner to said combustion treatment chamber during treatment of the exhaust gas by combusting and decomposing the exhaust gas at the time when said scraper plate is not in operation; and the fuel and the air are supplied from said main burner to said combustion treatment chamber during treatment of the exhaust gas by combusting and decomposing the exhaust gas at the time when said scraper plate is in the scraping operation.

8. The combustion-type exhaust gas treatment apparatus according to claim 7, wherein the oxygen is supplied to said combustion treatment chamber from a location different from a location of said main burner during treatment of the exhaust gas by combusting and decomposing the exhaust gas at the time when said scraper plate is in the scraping operation.

* * * * *